US005776876A

United States Patent [19]

Garris

[11] Patent Number: 5,776,876

[45] Date of Patent: Jul. 7, 1998

[54] AQUEOUS ACIDIC FILTER CLEANING COMPOSITION FOR REMOVING ORGANIC BIGUANIDE DEPOSITS

[75] Inventor: John P. Garris, Cumming, Ga.

[73] Assignee: Bio-Lab, Inc., Decatur, Ga.

[21] Appl. No.: 683,168

[22] Filed: Jul. 18, 1996

[51] Int. Cl.[6] ..... C11D 1/88; C11D 7/08; C11D 7/16

[52] U.S. Cl. ..... 510/247; 510/199; 510/253; 510/255; 510/269; 510/362; 510/364; 510/365; 510/421; 510/432; 510/434; 510/413; 210/169; 210/749; 210/753; 210/754

[58] Field of Search ..... 210/169, 749, 210/753, 754; 510/199, 247, 253, 255, 269, 362, 364, 365, 413, 421, 432, 434

[56] References Cited

U.S. PATENT DOCUMENTS

| | | | |
|---|---|---|---|
| 4,690,779 | 9/1987 | Baker et al. | 252/546 |
| 4,965,009 | 10/1990 | Baur et al. | 252/142 |
| 4,971,631 | 11/1990 | Sallee et al. | 134/3 |
| 5,324,443 | 6/1994 | Arif et al. | 252/142 |
| 5,362,422 | 11/1994 | Masters | 252/544 |
| 5,376,297 | 12/1994 | Choy et al. | 252/108 |
| 5,389,199 | 2/1995 | Awad et al. | 156/665 |
| 5,492,629 | 2/1996 | Ludwig et al. | 210/698 |

*Primary Examiner*—Paul Lieberman
*Assistant Examiner*—Charles Boyer
*Attorney, Agent, or Firm*—Woodard, Emhardt, Naughton Moriarty & McNett

[57] ABSTRACT

Effective, multi-use filter cleaning compositions include 5% to 60% of a strong acid, 1% to 40% of a surfactant, and 0.5% to 20% of a sequesterant/builder. The filter cleaning compositions optionally include 0.5% to 10% of a water soluble organic solvent, and/or 0.5% to 10% of a nonionic surfactant.

7 Claims, No Drawings

AQUEOUS ACIDIC FILTER CLEANING COMPOSITION FOR REMOVING ORGANIC BIGUANIDE DEPOSITS

FIELD OF THE INVENTION

The present invention relates generally to filter cleaners, and more particularly to a filter cleaning composition for use in cleaning swimming pool filters.

BACKGROUND TO THE INVENTION

Filtration is a primary component of many water treatment applications, and is especially critical in recreational water treatment applications such as swimming pools and spas. Without adequate filtration, pool and spa water may become dull and cloudy from the accumulation of suspended dirts, oils, and other particulates. The accumulation of these suspended particulates can cause the water to be unsightly as well as unhealthy.

Many filters have physical mechanisms for cleaning the filter media to allow for better filtration. Unfortunately, this physical cleaning does not always remove deposits and other restrictions from various filter media such as sand, diatomacious earth (DE) or cartridge filters. To better remove these accumulations, chemical cleaning is frequently necessary.

Effective filtration is particularly critical when the water is treated with hydrogen peroxide and/or oligomeric or polymeric quaternary ammonium compounds such as polyhexamethylene biguanide hydrochloride ("PHMB"). These cationic polymers have placed greater emphasis on filtration because organic contaminants are formed in these systems and may become large and entrenched in the filter media.

As to specific filter cleaning compositions, filter cleaners used in practice are problem specific. For example, calcified scale can form in filter media and then harden—thus restricting filtration. To overcome this problem highly acidic formulations containing strong acids such as hydrochloric, sulfuric, sulfamic, or phosphoric acids, etc. are used to economically dissolve these calcified deposits.

Filtration problems due to deposits from oils, and dirts are generally removed by alkaline/detergent and/or water-soluble solvent type formulations. These formulations are designed to remove these oil and dirt deposits from filter media through detergent and/or solvent action to increase filter efficacy. The action of these formulations is problem specific, but they do very little to treat problems they were not designed to correct.

A need therefore exists for effective filter cleaning compositions which are useful in a variety of water treatment applications. The present invention addresses this need.

SUMMARY OF THE INVENTION

Briefly describing the present invention there is provided a filter cleaning composition comprising 5% to 60% acid, 1% to 40% of an anionic, cationic or amphoteric/zwitterionic surfactant, and 0.5% to 20% of a sequesterant/builder. The compositions may optionally include 0.5% to 10% of a water soluble organic solvent, and/or 0.5% to 10% of a nonionic surfactant.

One object of the present invention is to provide new filter cleaning compositions that are particularly effective for use in swimming pools treated with hydrogen peroxide and/or polymeric quaternary ammonium compounds.

Further objects and advantages of the present invention will be apparent from the following description.

DESCRIPTION OF THE PREFERRED EMBODIMENT

For the purpose of promoting an understanding of the principles of the invention, reference will now be made to preferred embodiments and specific language will be used to describe the same. It will nevertheless be understood that no limitation of the scope of the invention is thereby intended, such alterations and further modifications in the preferred embodiments, and such further applications of the principles of the invention as described herein being contemplated as would normally occur to one skilled in the art to which the invention pertains.

As previously indicated, one aspect of the present invention relates to an improved filter cleaning composition for water treatment applications. The invention employs one or more strong acids, one or more surfactants, and at least one sequesterant/builder to clean scale, dirts, oils, and biguanide deposits from filter media. An optional water-soluble organic solvent or nonionic surfactant may also be formulated into the composition, as may be colorants, fragrances, and thickeners. The filter cleaning compositions of the present invention are true multipurpose chemical cleaning compositions that remove various filter restricting deposits from various filter media.

The compositions of the present invention are strongly acidic and preferably contain at least one of the following strong acids: hydrochloric, hydrofluoric, hydrobromic, sulfuric, sulfamic, sulfonic, phosphoric, or nitric or mixtures thereof. The compositions of the present invention preferably contain from 0.01% to 99.9% by weight of one or more of the above acids, with from 5% to 60% acid being more preferred.

The compositions of the present invention also contain at least one surfactant that has anionic, cationic, or amphoteric/zwitterionic properties. Effective anionic surfactants include but are not limited to linear alkyl benzene sulfonic acid/sulfonate, dodecyl benzene sulfonic acid/sulfonate, fatty alcohol sulfonates, fatty ester sulfates, amidosulfonates, acyl isethionates, acylsarconsinates, ethoxylated alcohol sulfates, olefin sulfonates, diphenyl sulfonate derivatives, alkane sulfonates, napthalene sulfonates, and phosphate esters surfactants. Effective cationic surfactants include but are not limited to various quaternary ammonium chlorides, primary, secondary, or tertiary alkyl or fatty amines, ethylenediamine alkoxylates, and ethoxylated alkylamines. Effective amphoteric/ zwitterionic surfactants include but are not limited to fatty amidopropyl betaine, alkyl iminodipropionate, amine oxides, alkoxylated imidodipropionate, alkyl iminodipropionate, fatty iminodipropionate, and the monocarboxylate, dicarboxylate, sulfate and sulfonate derivatives of imidazolines.

The composition of the present invention preferably contain from 0.01% to 60% by weight of one or more surfactants. More preferably 1% to 40% surfactant is used.

The compositions of the present invention also contain at least one sequesterant/builder. Preferably, the sequesterant/builder is a member selected from the group consisting of hydroxy-carboxylic acids, amino-carboxylic acids, polyamines, alkanolamines, polyphosphates, phosphonic acids, zeolites or amino acids and the like. Alternatively, polymers or oligomers that can be hydrolyzed or alternatively reacted to yield a sequesterant/builder may be used in the invention.

In one preferred aspect of the invention organic acids are used as builders/sequesterants. Such organic acids include, but are not limited to, oxalic acid, suberic acid, acetic acid, tricarballic acid, succinic acid, malonic acid, and maleic acid and the salts thereof. Most preferably hydroxy-carboxylic acids such as citric acid, gluconic acid, tartronic acid, lactic acid, tartaric acid, malic acid, glyceric acid, or tetrahydroxy succinic acid and the salts thereof are used. The lactone or ester forms of said acids may also be used. Glucono delta lactone (GDL), citric acid, phosphonobutane tricarboxylic acid (PBTC), and hydroxyethylidenediphosphonic acid (HEDP) are most preferred.

The invention may also include an ionic water-soluble polymeric agent as a builder/sequesterant. Such water-soluble polymeric agents include, but are not limited to, anionic polymers like polyacrylic acid, polymethacrylic acid, polyvinyl sulfonic acid, polystyrene sulfonic acid, polymaleic acid, polyaspartic acid, copolymers, terpolymers, or tetrapolymers thereof or the sodium, potassium, ammonium, or calcium salts of said polymers. Cationic polymers such as poly[oxyethylene-(dimethylimino) ethylene-(dimethylimino) ethylene dichloride], polyvinyl amine, chitosan, polyethylene amine or a polymer of 1,6-hexanediamine-N,N,N',N'-tetramethyl or the fluoride, chloride, or bromide salts thereof, and the like may also be used.

The composition of the present invention may contain from 0.01% to 30% by weight of one or more sequesterant/builder. Preferably, from 0.5% to 20% sequesterant/builder is used.

The compositions of the present invention may optionally contain a water-soluble organic solvent such as glycol ethers, alcohols, glycols, or acetone and the like, or a nonionic surfactant such as a polyoxyethylene thioether, ethoxylated alcohol, fatty acid alkanolamides, ethoxylated alkylphenols, glycerol esters, polyoxyethylene esters, allyl glycosides or other carbohydrate based surfactants, and the like. The composition of the present invention may use these components in the formulation to help prevent phase separation in some compositions.

The composition of the present invention may contain from 0.01% to 20% by weight of the water-soluble organic solvent or nonionic surfactant. Preferred compositions contain from 0.5% to 10% water-soluble organic solvent or nonionic surfactant.

The compositions of the present invention may also contain effective amounts of a colorant to aid in the method of filter cleaning. Fragrances to cover any strong odors, and thickeners to aid in the method of the present invention may also be included.

Reference will now be made to specific examples using the processes described above. It is to be understood that the examples are provided to more completely describe preferred embodiments, and that no limitation to the scope of the invention is intended thereby.

EXAMPLE 1

Preparation of a Filter Cleaning Composition with an Amphoteric Surfactant.

A filter cleaning composition is prepared by mixing 20 grams commercial hydrochloric acid, 10 grams of an amphoteric surfactant, (alkyl iminodipropionic acid) (Alkali Surfactant NM, Tomah Products, Inc.), 10 grams of glucono delta lactone (GDL), 10 grams of PBTC, and 50 grams water.

EXAMPLE 2

Preparation of a Filter Cleaning Composition with Cationic and Amphoteric Surfactants.

A filter cleaning composition is prepared by mixing 20 grams of commercial hydrochloric acid, 10 grams of a cationic surfactant/thickener, (ethoxylated alkyl amine) (Acid Thickener, Tomah Products, Inc.), 10 grams of an amphoteric surfactant, (amine oxide) (AO-728 Special, Tomah Products), 10 grams of GDL, and 50 grams water.

EXAMPLE 3

Preparation of a Filter Cleaning Composition with an Anionic Surfactant.

A filter cleaning composition is prepared by mixing 20 grams of commercial hydrochloric acid, 5 grams of an anionic surfactant, (dodecyl diphenyl ether disulfonic acid) (Poly-Tergent®2Al, Olin Corp.), 5 grams PBTC, 5 grams Polyacrylic acid (Aquatreat®AR-6, Alco Chemical Corp.), 5 grams glycol ether, and 60 grams water.

EXAMPLE 4

Preparation of a Filter Cleaning Composition with Anionic and Nonionic Surfactants.

A filter cleaning composition is prepared by mixing 20 grams of commercial hydrochloric acid, 5 grams of an anionic surfactant, (phosphate ester) (Stephac 8170, Stepan Co.), 5 grams PBTC, 5 grams glycol ether, 5 grams of a nonionic surfactant, (ethoxylated fatty alcohol) (BioSoft EA-10, Stepan Co.), and 60 grams water.

EXAMPLE 5

Preparation of a Filter Cleaning Composition with an Amphoteric Surfactant.

A filter cleaning composition is prepared by mixing 12.5 grams commercial hydrochloric acid, 12.5 grams commercial phosphoric acid, 10 grams amphoteric surfactant, (alkyl iminodipropionic acid) (Alkali Surfactant NM, Tomah Products, Inc.), 10 grams GDL, and 55 grams water.

EXAMPLE 6

Preparation of a Filter Cleaning Composition with Amphoteric and Cationic Surfactants.

A filter cleaning composition is prepared by mixing 20 grams commercial grade hydrochloric acid, 10 grams of an amphoteric surfactant, (myristamine oxide) (Ammonyx MO, Stepan Co.), 10 grams of a cationic surfactant, (quaternary ammonium chloride) (LA-5, Tomah Products, Inc.), 10 grams citric acid, 50 grams water.

EXAMPLE 7

Preparation of a Filter Cleaning Composition with Anionic and Nonionic Surfactants.

A filter cleaning composition is prepared by mixing 12.5 grams commercial grade hydrochloric acid, 12.5 grams phosphoric acid, 10 grams of an anionic surfactant, (olefin sulfonate) (BioTerge AS-90, Stepan Co.), 10 grams triethanolamine, 5 grams of a nonionic surfactant, (amine polyglycol condensate) (Triton CF-32, Union Carbide), 50 grams water.

EXAMPLE 8

Preparation of a Filter Cleaning Composition with an Anionic Surfactant.

A filter cleaning composition is prepared by mixing 20 grams commercial grade hydrochloric acid, 10 grams of an anionic surfactant, (linear alkyl benzene sulfonic acid) (SA-597, Vista Chemical Co.), 15 grams HEDP, and 55 grams water.

EXAMPLE 9

Preparation of a Filter Cleaning Composition with an Anionic Surfactant.

A filter cleaning composition is prepared by mixing 20 grams sulfamic acid, 10 grams of an anionic surfactant, (dodecyl benzene sulfonic acid) (Bio-Soft S100, Stepan Co.), 10 grams of an anionic surfactant (phosphate ester) (Stephac 8170, Stepan Co.), 10 grams oxalic acid, and 50 grams water.

EXAMPLE 10

Preparation of a Filter Cleaning Composition with an Anionic Surfactant.

A filter cleaning composition is prepared by mixing 25 grams commercial grade hydrochloric acid, 10 grams of an anionic surfactant, (alkyl napthalene sulfonate) (Petro® AA, Witco, Corp.), 10 grams HEDP, and 55 grams water.

EXAMPLE 11

Preparation of a Filter Cleaning Composition with Anionic and Nonionic Surfactants.

A filter cleaning composition is prepared by mixing 21 grams phosphoric acid, 10 grams of an anionic surfactant, (primary alkane sulfonate) (PAS-8S, Stepan Co.), 10 grams citric acid, 10 grams of a nonionic surfactant, (polyethoxylated straight-chain alcohol) (Triton® DF-16, Union Carbide), 49 grams water.

EXAMPLE 12

Preparation of a Filter Cleaning Composition with an Anionic Surfactant.

A filter cleaning composition is prepared by mixing 12.5 grams commercial grade hydrochloric acid, 12.5 grams phosphoric acid, 10 grams of an anionic surfactant, (phosphate ester) (Stephac 8170, Stepan Co.), 5 grams EDTA, and 60 grams water.

EXAMPLE 13

Preparation of a Filter Cleaning Composition with an Anionic Surfactant.

A filter cleaning composition is prepared by mixing 12.5 grams hydrochloric acid, 12.5 grams sulfuric acid, 10 grams of an anionic surfactant, (primary alkane sulfonate) (PAS-8S, Stepan Co.), 10 grams acetic acid, and 55 grams water.

EXAMPLE 14

Preparation of a Filter Cleaning Composition with an Amphoteric Surfactant.

A filter cleaning composition is prepared by mixing 12.5 grams commercial grade hydrochloric acid, 12.5 grams phosphoric, 10 grams of an amphoteric surfactant, (alkyl iminodipropionic acid) (Alkali Surfactant NM, Tomah Products, Inc.), 10 grams citric acid, and 55 grams water.

As previously described, water-soluble organic solvent or nonionic surfactant may optionally be added to the above formulations to help prevent phase separation in some compositions. Acid stable dyes may also be added, as may a thickener to aid in the treatment process. These components assist in the method of applying the present invention.

In the above examples the composition of the present invention is in a liquid form. Delivery in a solid form is also an option.

EXAMPLE 15

Measurement of Filter Cleaning Activity

To measure activity of various formulations, an assay was developed using material collected from swimming pool filters that had significant turbidity problems with the water. For example, deposits collected from sand filters that used a PHMB treatment program were isolated from the sand. These deposits were the basis for initial efficacy trials in the lab. Examples 1–5 below tested inventive compositions on deposits from a first pool filter, while Examples 6–14 below tested compositions on deposits from a second pool filter. These laboratory results were confirmed by field tests where the turbidity of the water was the primary factor determining the efficacy of the various formulations.

The laboratory activity was gauged by measuring 2.9 to 3.1 grams of material isolated from the above mentioned filters. This material was treated with 10 ml of a 1:10 or 1:20 dilution of the concentrated filter cleaning formulations. These samples were allowed to sit over the test period of 1 to 24 hours to quantify ingredients that efficiently dissolved the deposits.

The results from the laboratory work unexpectedly showed that surfactants enhanced the activity of strongly acidic compounds such as hydrochloric acid and phosphoric acid. Anionic, cationic, and amphoteric/zwitterionic surfactants showed various activities to help dissolve these deposits. Unexpectedly, some cationic and amphoteric/zwitterionics detergent surfactants displayed equally good detergency properties. The addition of the building/sequesterant like gluconic acid or phosphonobutane tricaboxylic acid (PBTC) further enhanced performance.

The controls for this assay would be <5% activity by the addition of distilled water and 33% activity by adding 20 grams of commercial hydrochloric acid. The composition of U.S. Pat. No. 5,324,443 by Olin Corporation showed 35% activity using this laboratory assay. Activity was based on a 6 hour treatment using a 1:10 dilution of the formulation.

| Activity (% dissolved) | | | | |
|---|---|---|---|---|
| Example 1 | Example 2 | Example 3 | Example 4 | Example 5 |
| 57 | 55 | 55 | 52 | 67 |
| Example 6 | Example 7 | Example 8 | Example 9 | Example 10 |
| 95 | 77 | 72 | 56 | 83 |
| Example 11 | Example 12 | Example 13 | Example 14 | |
| 85 | 76 | 73 | 94 | |

The above formulations were tested on swimming pool filters that were having significant filtration problems. For example, about 20 pools that had sand filters were tested with the experimental product of Example 5. These pools were treated by initially backwashing the filter to physically remove any material from the filter bed. The product which had a small amount of dye was poured in the skimmer or the pump itself and backwashed until the dye was seen in the sight glass of the filter. This allowed the person applying the product to know when the product was inside the filter. The product was allowed to sit for 12 to 24 hours. At this point, the person applying the composition of the invention would backwash the filter again. This will discharge much of the organic buildup through this physical and chemical removal process. About 80% of these pools cleared within 1 to 3 days after treatment. This treatment regime works well for most DE filters as well.

The method of applying the product is improved when the route of administering the product is more efficient. With the examples shown above, a 1:10 to 1:20 dilution of the product is provided based on the volume of water within the plumbing and filter assembly. A smaller dilution, such as 1:5, is more effective at dissolving filter-clogging deposits.

A more effective delivery system is accomplished by adding a thickening agent to the composition of the present invention. A thickened product stays together for a longer period of time in the process, thus allowing a more concentrated form of the present invention to act on the deposits within the filter.

The form of the present invention can be used on cartridge and some DE filters by direct addition of the product to the surface of the filter with a sprayer containing the concentrated product or by diluting the product by a ratio from 1:5 to 1:20 and allowing the cartridge to soak. The dilution is based on cartridge size and available vessels for diluting the product. This will clean filters of filter-clogging deposits which can be rinsed with a water sprayer.

While the invention has been illustrated and described in detail in the foregoing description, the same is to be considered as illustrative and not restrictive in character, it being understood that only the preferred embodiment has been shown and described and that all changes and modifications that come within the spirit of the invention are desired to be protected.

We claim:

1. A filter cleaning composition consisting essentially of:

(a) from 5% to 60% by weight of one or more acids selected from the group consisting of hydrochloric, hydrofluoric, hydrobromic, sulfuric, sulfamic, sulfonic, phosphoric and nitric acids;

(b) from 1% to 40% of an alkyl iminodipropionic acid amphoteric surfactant;

(c) from 0.5% to 20% of a sequesterant/builder selected from the group consisting of glucono delta lactone (GDL), citric acid, phosphonobutane tricarboxylic acid (PBTC), and hydroxyethylidenediphosphonic acid (HEDP); and (d) water.

2. A method of cleaning organic deposits from a swimming pool filter, said method comprising contacting organic deposits on a swimming pool filter with a filter cleaning composition comprising:

(a) from 0.1% to 9.9% by weight of an acid selected from the group consisting of hydrochloric, hydrofluoric, hydrobromic, sulfuric, sulfamic, sulfonic, phosphoric and nitric acids;

(b) from 0.1% to 60% of a cationic or amphoteric surfactant;

(c) from 0.01% to 30% of a sequesterant/builder; and (d) water.

3. A method of cleaning organic deposits from a swimming pool filter, said method comprising contacting organic deposits on a swimming pool filter with a filter cleaning composition comprising:

(a) from 5% to 60% by weight of an acid selected from the group consisting of hydrochloric, hydrofluoric, hydrobromic, sulfuric, sulfamic, sulfonic, phosphoric and nitric acids;

(b) from 1% to 40% of an anionic surfactant;

(c) from 0.5% to 20% of a sequesterant/builder;

(d) from 0.5% to 10% of a water soluble organic solvent; and (e) water.

4. A method of cleaning organic deposits from a swimming pool filter, said method comprising contacting organic deposits on a swimming pool filter with a filter cleaning composition comprising:

(a) from 5% to 60% by weight of an acid selected from the group consisting of hydrochloric, hydrofluoric, hydrobromic, sulfuric, sulfamic, sulfonic, phosphoric and nitric acids;

(b) from 1% to 40% of an anionic surfactant;

(c) from 0.5% to 20% of a sequesterant/builder;

(d) from 0.5% to 10% of a nonionic surfactant; and (e) water.

5. The method of claim 2 wherein said contacting is accomplished by direct addition of said filter cleaning composition to the surface of a swimming pool filter, or by diluting said filter cleaning composition by a ratio of from 1:5 to 1:20 and allowing a swimming pool filter to soak therein.

6. The method of claim 3 wherein said contacting is accomplished by direct addition of said filter cleaning composition to the surface of a swimming pool filter, or by diluting said filter cleaning composition by a ratio of from 1:5 to 1:20 and allowing a swimming pool filter to soak therein.

7. The method of claim 4 wherein said contacting is accomplished by direct addition of said filter cleaning composition to the surface of a swimming pool filter, or by diluting said filter cleaning composition by a ratio of from 1:5 to 1:20 and allowing a swimming pool filter to soak therein.

* * * * *

UNITED STATES PATENT AND TRADEMARK OFFICE

CERTIFICATE OF CORRECTION

PATENT NO : 5,776,876

DATED : July 7, 1998

INVENTOR(S) : John P. Garris

It is certified that error appears in the above-identified patent and that said Letters Patent is hereby corrected as shown below:

In column 8, line 1, please change "9.9%" to --99.9%--.

Signed and Sealed this

First Day of December, 1998

*Attest:*

*Attesting Officer*

Bruce Lehman

BRUCE LEHMAN

*Commissioner of Patents and Trademarks*